US007543762B1

(12) United States Patent
Cheng

(10) Patent No.: US 7,543,762 B1
(45) Date of Patent: Jun. 9, 2009

(54) SPRAYING GUN HAVING DIFFERENT SPRAYING MODES

(76) Inventor: Shih-Chung Cheng, 177, Lane 449, Sec. 2, Jhangcao Rd., Hemei Township, Changhua County (TW)

( * ) Notice: Subject to any disclaimer, the term of this patent is extended or adjusted under 35 U.S.C. 154(b) by 0 days.

(21) Appl. No.: 11/876,934

(22) Filed: Oct. 23, 2007

(51) Int. Cl.
*B05B 1/32* (2006.01)
*B05B 1/30* (2006.01)
*B05B 1/12* (2006.01)
*B05B 9/01* (2006.01)

(52) U.S. Cl. ..... 239/438; 239/391; 239/437; 239/456; 239/458; 239/525

(58) Field of Classification Search ..... 239/391–395, 239/436–441, 451, 456–458, 525, 530, 537–539, 239/541, 579
See application file for complete search history.

(56) References Cited

U.S. PATENT DOCUMENTS 2,993,655 A * 7/1961 O'Brien ..... 239/582.1
3,001,725 A * 9/1961 Lockett ..... 239/458
3,746,262 A * 7/1973 Bete et al. ..... 239/458
4,095,747 A * 6/1978 Anderson ..... 239/288.5
5,979,800 A * 11/1999 Takagi ..... 239/440
6,758,413 B1 * 7/2004 Chen ..... 239/525
7,028,923 B2 * 4/2006 Bonzer et al. ..... 239/451
2005/0263623 A1 * 12/2005 Hofer ..... 239/589

* cited by examiner

*Primary Examiner*—Darren W Gorman
(74) *Attorney, Agent, or Firm*—Alan Kamrath; Kamrath & Associates PA

(57) ABSTRACT

A spraying gun includes a gun body, a first seal ring, a second seal ring, a spraying head, a control pipe, and an outer casing. Thus, the spraying gun can perform an atomized water outlet mode and a linear or horn-shaped water outlet mode. In addition, a user only needs to rotate the control pipe relative to the gun body to switch the two different water outlet modes of the spraying gun, thereby facilitating the user operating the spraying gun. Further, the atomized water outlet mode of the spraying gun can distribute and reduce the water flow rate and the water pressure efficiently, so that the spraying gun is available for a gardening use.

18 Claims, 6 Drawing Sheets

SPRAYING GUN HAVING DIFFERENT SPRAYING MODES

BACKGROUND OF THE INVENTION

1. Field of the Invention

The present invention relates to a spraying gun and, more particularly, to a spraying gun that sprays or injects water outwardly to water a plant or wash a car.

2. Description of the Related Art

A conventional spraying gun has a diffusion spraying mode to spray water outwardly with a smaller flow rate. Another conventional spraying gun has a linear column spraying mode to spray water outwardly with a larger flow rate. However, the conventional spraying gun only has a single water outlet mode, thereby limiting the versatility of the conventional spraying gun.

BRIEF SUMMARY OF THE INVENTION

In accordance with the present invention, there is provided a spraying gun, comprising a gun body having a first end having an inside provided with an inlet channel and a periphery provided with an outlet hole connected to the inlet channel and a second end having an inside provided with an outlet channel and a periphery provided with an inlet hole connected to the outlet channel, a first seal ring mounted on the gun body, a second seal ring mounted on the gun body, a spraying head mounted on the second end of the gun body and having a first nozzle connected to the outlet channel of the gun body, and a control pipe rotatably and movably mounted on the gun body and having a first end provided with a second nozzle surrounding the spraying head, a second end provided with a first sealing portion detachably pressing the first seal ring to open or close a connection between the outlet hole and the inlet hole of the gun body and a mediate portion provided with a second sealing portion detachably pressing the second seal ring to open or close a connection between the inlet hole of the gun body and the second nozzle of the control pipe.

The primary objective of the present invention is to provide a spraying gun having different spraying modes.

Another objective of the present invention is to provide a spraying gun that can perform an atomized water outlet mode and a linear or horn-shaped water outlet mode, thereby enhancing the versatility of the spraying gun.

A further objective of the present invention is to provide a spraying gun, wherein a user only needs to rotate the control pipe relative to the gun body to switch the two different water outlet modes of the spraying gun, thereby facilitating the user operating the spraying gun.

A further objective of the present invention is to provide a spraying gun, wherein the atomized water outlet mode of the spraying gun can distribute and reduce the water flow rate and the water pressure efficiently, so that the spraying gun is available for a gardening use.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
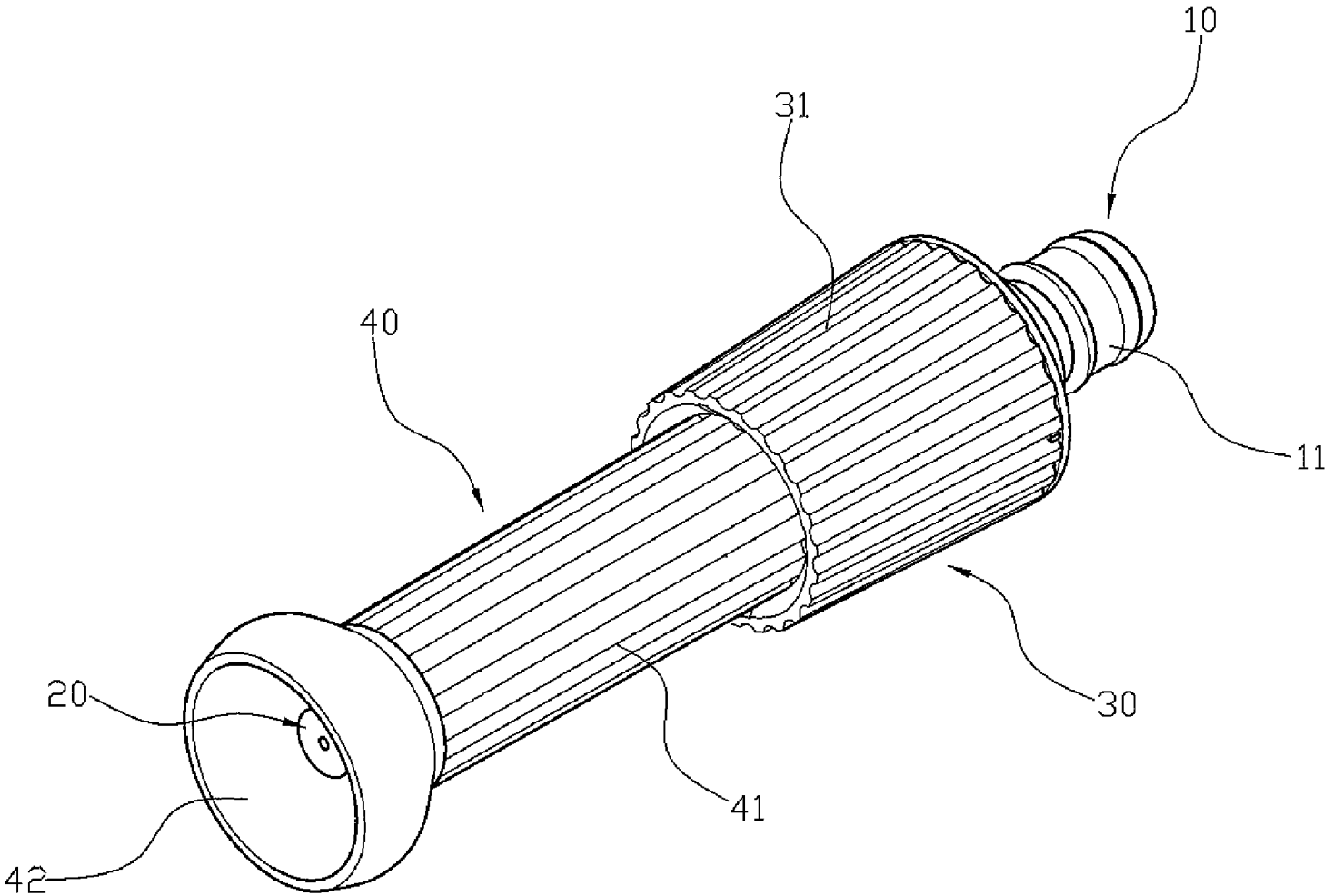
FIG. 1 is a perspective view of a spraying gun in accordance with the preferred embodiment of the present invention.
Figure 2:
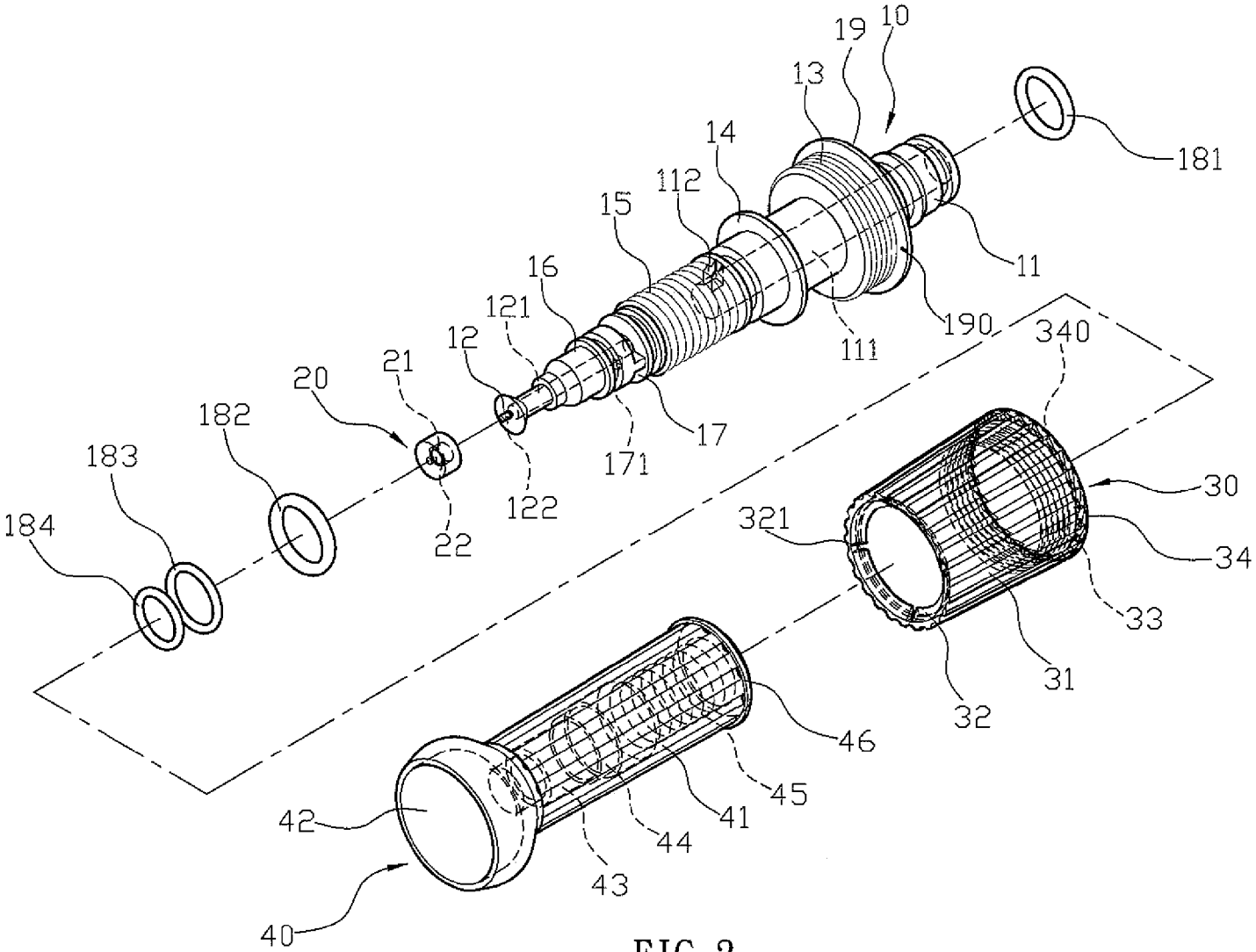
FIG. 2 is an exploded perspective view of the spraying gun as shown in FIG. 1.
Figure 3:
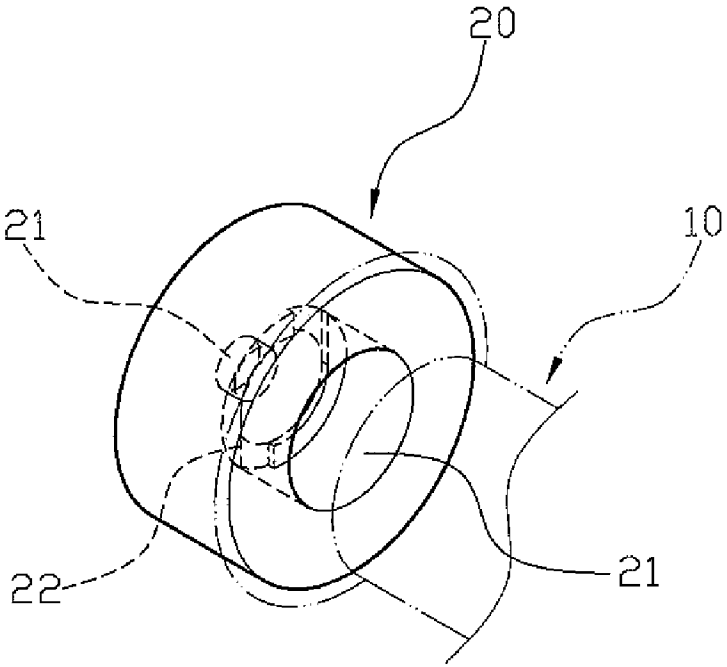
FIG. 3 is a perspective view of a spraying head of the spraying gun as shown in FIG. 2.

Referring to the drawings and initially to FIGS. 1-4, a spraying gun in accordance with the preferred embodiment of the present invention comprises a gun body 10 having a first end 11 having an inside provided with an inlet channel 111 and a periphery provided with an outlet hole 112 connected to the inlet channel 111 and a second end 16 having an inside provided with an outlet channel 121 and a periphery provided with an inlet hole 171 connected to the outlet channel 121, a first seal ring 183 mounted on the gun body 10, a second seal ring 184 mounted on the gun body 10, a spraying head 20 mounted on the second end of the gun body 10 and having a first nozzle 21 connected to the outlet channel 121 of the gun body 10, a control pipe 40 rotatably and movably mounted on the gun body 10 and having a first end provided with a second nozzle 42 surrounding the spraying head 20, a second end provided with a first sealing portion 44 detachably pressing the first seal ring 183 to open or close a connection between the outlet hole 112 and the inlet hole 171 of the gun body 10 and a mediate portion provided with a second sealing portion 43 detachably pressing the second seal ring 184 to open or close a connection between the inlet hole 171 of the gun body 10 and the second nozzle 42 of the control pipe 40, and an outer casing 30 mounted on the gun body 10 to limit a movement of the control pipe 40.

The first seal ring 183 is located between the outlet hole 112 and the inlet hole 171 of the gun body 10. The second seal ring 184 is located between the inlet hole 171 of the gun body 10 and the second nozzle 42 of the control pipe 40.

The first end 11 of the gun body 10 has an outer wall provided with an O-ring 181. The second end 16 of the gun body 10 has an end face provided with a protruding post 12 which is inserted into the first nozzle 21 of the spraying head 20 and has a periphery provided with an outlet bore 122 connected between the first nozzle 21 of the spraying head 20 and a first end of the outlet channel 121 of the gun body 10, and the outlet channel 121 of the gun body 10 has a second end connected to the inlet hole 171 of the gun body 10. The periphery of the second end 16 of the gun body 10 is provided with an annular groove 17 located between the first seal ring 183 and the second seal ring 184 and connected between the inlet hole 171 and the outlet hole 112 of the gun body 10. The gun body 10 is provided with an outer thread 15, an outer threading 13 and an annular stop flange 14 located between the outer thread 15 and the outer threading 13. The gun body 10 has a tapered outer diameter gradually reduced from the outer threading 13, the stop flange 14 and the outer thread 15 to the second end 16 of the gun body 10. The outer threading 13 of the gun body 10 has an end provided with a protruding stop wall 19 which has a locking boss 190. A third seal ring 182 is mounted on an outer wall of the gun body 10 to press an inner wall of the control pipe 40, and the outlet hole 112 of the gun body 10 is located between the first seal ring 183 and the third seal ring 182.

The first nozzle 21 of the spraying head 20 has a stepped shape and has a peripheral wall provided with a helical portion 22 facing the outlet bore 122 of the protruding post 12 of the gun body 10.

The outer casing 30 has an outer wall provided with a plurality of anti-skid portions 31. The outer casing 30 has an inner wall having a first end provided with an inner threading 33 screwed onto the outer threading 13 of the gun body 10 and a second end provided with a protruding stop edge 32. The first end of the outer casing 30 has an end portion 34 abutting the stop wall 19 of the gun body 10 and provided with a plurality of tooth-shaped locking grooves 340 engaged with the locking boss 190 of the stop wall 19 of the gun body 10. The stop edge 32 of the outer casing 30 has a periphery provided with a plurality of slits 321 so that the stop edge 32 of the outer casing 30 has a flexible feature.

The control pipe 40 has an outer wall provided with a plurality of anti-skid portions 41. The second end of the control pipe 40 is provided with an inner thread 45 screwed onto the outer thread 15 of the gun body 10 and has an end portion provided with a substantially cone-shaped protruding stop rim 46 that is limited and movable between the stop flange 14 of the gun body 10 and the stop edge 32 of the outer casing 30. The stop rim 46 of the control pipe 40 is forcibly fitted through the stop edge 32 of the outer casing 30 into the outer casing 30 by the flexible feature of the stop edge 32 of the outer casing 30. When the stop rim 46 of the control pipe 40 is movable to abut the stop flange 14 of the gun body 10, the first sealing portion 44 of the control pipe 40 presses the first seal ring 183, and the second sealing portion 43 of the control pipe 40 presses the second seal ring 184. The second nozzle 42 of the control pipe 40 has a substantially horn-shaped cross-sectional profile. The control pipe 40 has a tapered inner diameter gradually reduced from the inner thread 45 and the first sealing portion 44 to the second sealing portion 43 of the control pipe 40.

The first sealing portion 44 of the control pipe 40 is movable between a first position where the first sealing portion 44 presses the first seal ring 183 to interrupt a connection between the outlet hole 112 and the inlet hole 171 of the gun body 10 and a second position where the first sealing portion 44 is detached from the first seal ring 183 to connect the outlet hole 112 to the inlet hole 171 of the gun body 10. The second sealing portion 43 of the control pipe 40 is movable between a first position where the second sealing portion 43 presses the second seal ring 184 to interrupt a connection between the inlet hole 171 of the gun body 10 and the second nozzle 42 of the control pipe 40 and a second position where the second sealing portion 43 is detached from the second seal ring 184 to connect the inlet hole 171 of the gun body 10 to the second nozzle 42 of the control pipe 40.

Figure 4:
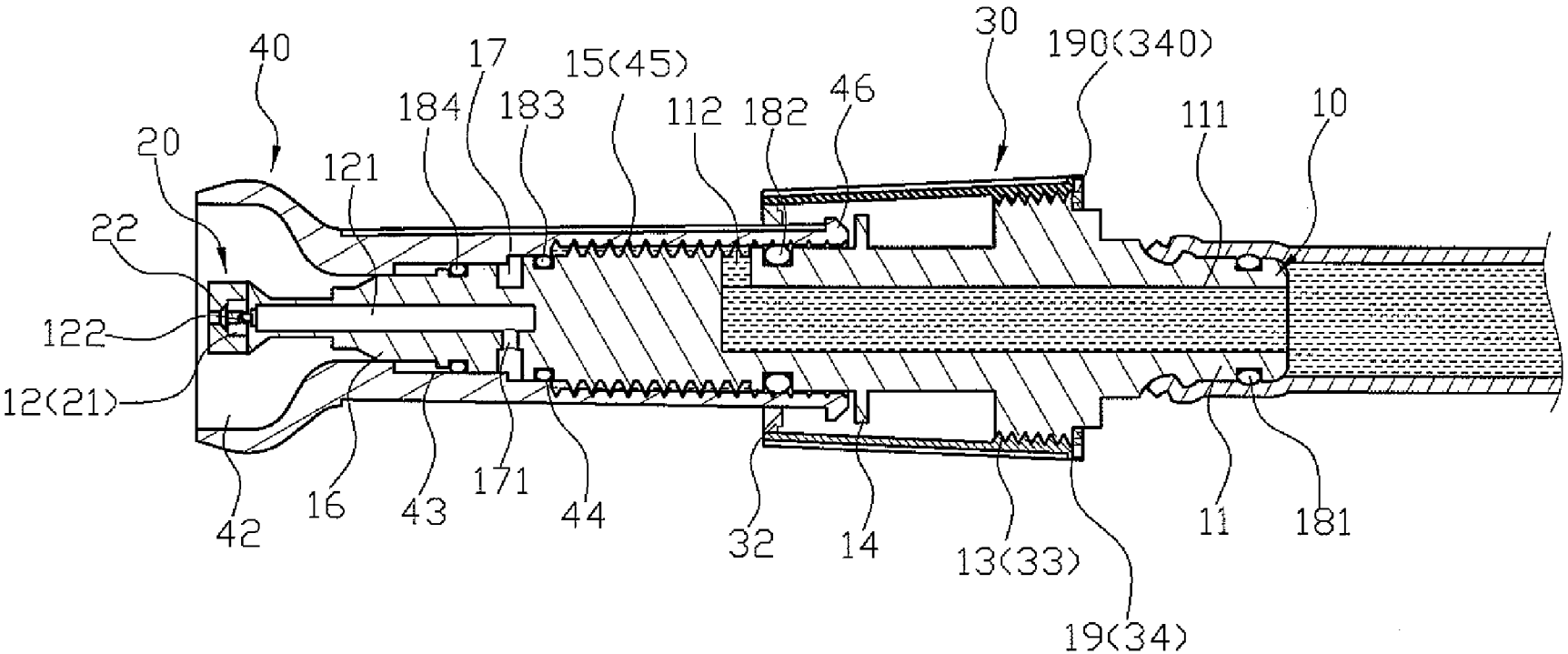
FIG. 4 is a side cross-sectional view of the spraying gun as shown in FIG. 1.

As shown in FIG. 4, the first sealing portion 44 of the control pipe 40 presses the first seal ring 183 to interrupt the connection between the outlet hole 112 and the inlet hole 171 of the gun body 10.

Figure 5:
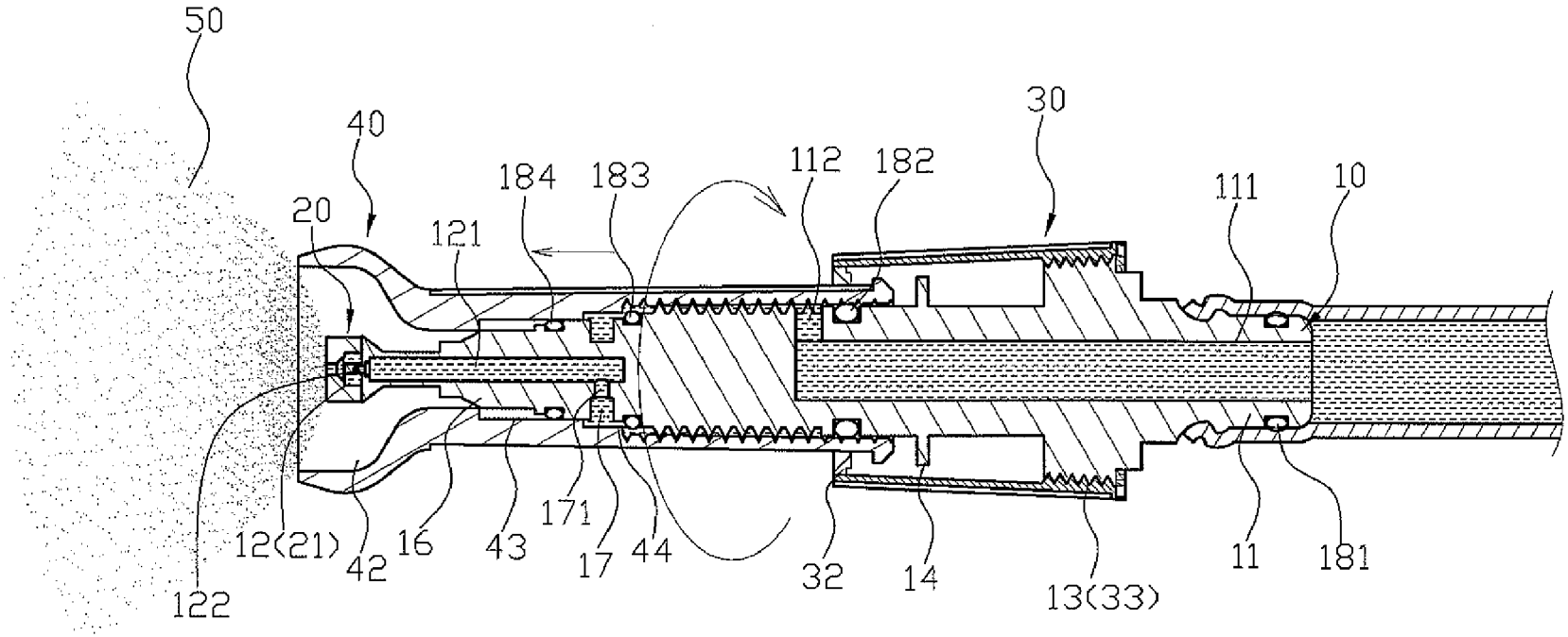
FIG. 5 is a schematic operational view of the spraying gun as shown in FIG. 4.

As shown in FIG. 5, the control pipe 40 is movable outwardly relative to the gun body 10 by rotation of the control pipe 40 relative to the gun body 10 so that the first sealing portion 44 of the control pipe 40 is movable to detach from the first seal ring 183 to connect the outlet hole 112 to the inlet hole 171 of the gun body 10, and the water from the inlet channel 111 of the gun body 10 in turn flows through the outlet hole 112, a gap between the control pipe 40 and the gun body 10, the annular groove 17, the inlet hole 171, the outlet channel 121 and the outlet bore 122 of the gun body 10 into the first nozzle 21 of the spraying head 20. At this time, the water in the first nozzle 21 of the spraying head 20 is accelerated to produce a centrifugal rotation movement by action of the helical portion 22 so that when the water is injected outwardly from the first nozzle 21 of the spraying head 20, the water is atomized to form an atomized water outlet mode 50.

Figure 6:
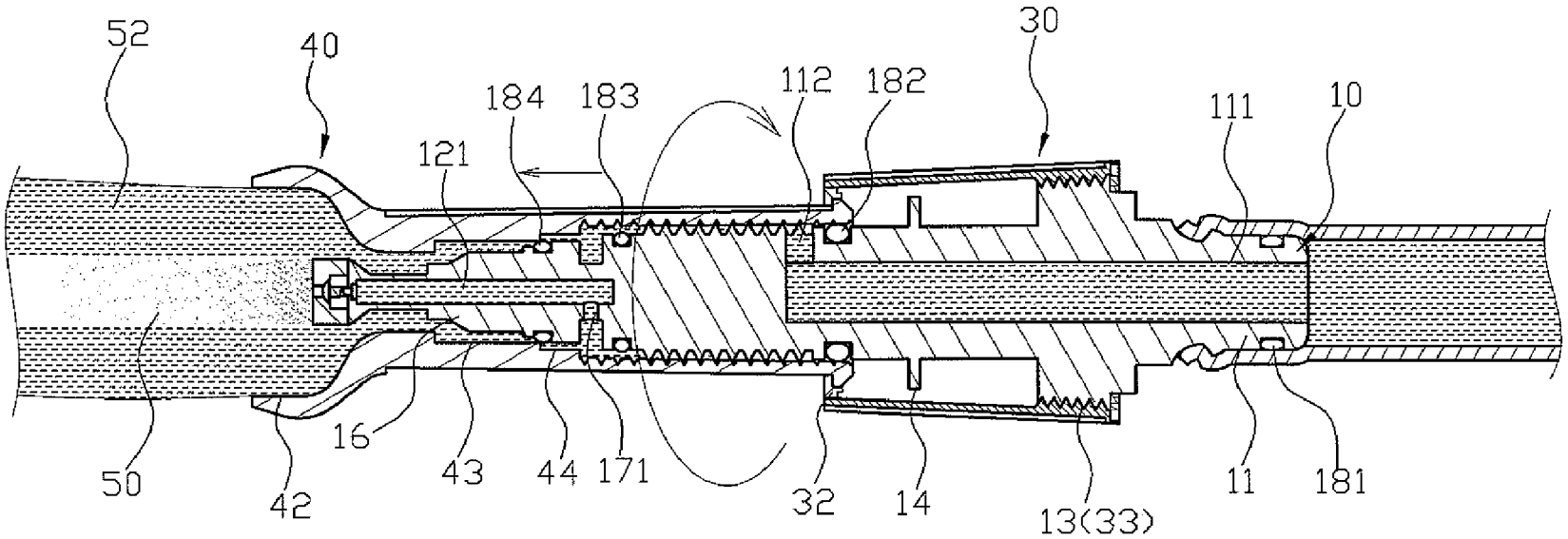
FIG. 6 is a schematic operational view of the spraying gun as shown in FIG. 5.

As shown in FIG. 6, the control pipe 40 is further movable outwardly relative to the gun body 10 by rotation of the control pipe 40 relative to the gun body 10 so that the second sealing portion 43 of the control pipe 40 is movable to detach from the second seal ring 184 to connect the inlet hole 171 of the gun body 10 to the second nozzle 42 of the control pipe 40, and the water from the inlet channel 111 of the gun body 10 in turn flows through the outlet hole 112 and the gap between the control pipe 40 and the gun body 10 into the second nozzle 42 of the control pipe 40. Then, the water is injected outwardly from the second nozzle 42 of the control pipe 40 to form a linear or horn-shaped water outlet mode 52.

Accordingly, the spraying gun can perform an atomized water outlet mode 50 and a linear or horn-shaped water outlet mode 52, thereby enhancing the versatility of the spraying gun. In addition, a user only needs to rotate the control pipe 40 relative to the gun body 10 to switch the two different water outlet modes of the spraying gun, thereby facilitating the user operating the spraying gun. Further, the atomized water outlet mode 50 of the spraying gun can distribute and reduce the water flow rate and the water pressure efficiently, so that the spraying gun is available for a gardening use.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A spraying gun, comprising:

a gun body having a first end having an inside provided with an inlet channel and a periphery provided with an outlet hole connected to the inlet channel and a second end having an inside provided with an outlet channel and a periphery provided with an inlet hole connected to the outlet channel;

a first seal ring mounted on the gun body;

a second seal ring mounted on the gun body;

a spraying head mounted on the second end of the gun body and having a first nozzle connected to the outlet channel of the gun body;

a control pipe rotatably and movably mounted on the gun body and having a first end provided with a second nozzle surrounding the spraying head, a second end provided with a first sealing portion detachably pressing the first seal ring to open or close a connection between the outlet hole and the inlet hole of the gun body and a mediate portion provided with a second sealing portion detachably pressing the second seal ring to open or close a connection between the inlet hole of the gun body and the second nozzle of the control pipe;

an outer casing mounted on the gun body to limit a movement of the control pipe;

wherein the gun body is provided with an outer thread, an outer threading and an annular stop flange located between the outer thread and the outer threading;

the outer casing has an inner wall having a first end provided with an inner threading screwed onto the outer threading of the gun body and a second end provided with a protruding stop edge;

the second end of the control pipe is provided with an inner thread screwed onto the outer thread of the gun body and has an end portion provided with a protruding stop rim that is limited and movable between the stop flange of the gun body and the stop edge of the outer casing.

2. A spraying gun, comprising:

a gun body having a first end having an inside provided with an inlet channel and a periphery provided with an outlet hole connected to the inlet channel and a second end having an inside provided with an outlet channel and a periphery provided with an inlet hole connected to the outlet channel;

a first seal ring mounted on the gun body;

a second seal ring mounted on the gun body;

a spraying head mounted on the second end of the gun body and having a first nozzle connected to the outlet channel of the gun body;

a control pipe rotatably and movably mounted on the gun body and having a first end provided with a second nozzle surrounding the spraying head, a second end provided with a first sealing portion detachably pressing the first seal ring to open or close a connection between the outlet hole and the inlet hole of the gun body and a mediate portion provided with a second sealing portion detachably pressing the second seal ring to open or close a connection between the inlet hole of the gun body and the second nozzle of the control pipe;

wherein the second end of the gun body has an end face provided with a protruding post which is inserted into the first nozzle of the spraying head and has a periphery provided with an outlet bore connected between the first nozzle of the spraying head and a first end of the outlet channel of the gun body.

3. The spraying gun in accordance with claim 2, wherein the first nozzle of the spraying head has a peripheral wall provided with a helical portion facing the outlet bore of the protruding post of the gun body.

4. The spraying gun in accordance with claim 2, wherein the outlet channel of the gun body has a second end connected to the inlet hole of the gun body.

5. The spraying gun in accordance with claim 1, wherein the first sealing portion of the control pipe is movable between a first position where the first sealing portion presses the first seal ring to interrupt a connection between the outlet hole and the inlet hole of the gun body and a second position where the first sealing portion is detached from the first seal ring to connect the outlet hole to the inlet hole of the gun body.

6. The spraying gun in accordance with claim 5, wherein the second sealing portion of the control pipe is movable between a first position where the second sealing portion presses the second seal ring to interrupt a connection between the inlet hole of the gun body and the second nozzle of the control pipe and a second position where the second sealing portion is detached from the second seal ring to connect the inlet hole of the gun body to the second nozzle of the control pipe.

7. The spraying gun in accordance with claim 1, wherein the periphery of the second end of the gun body is provided with an annular groove located between the first seal ring and the second seal ring and connected between the inlet hole and the outlet hole of the gun body.

8. The spraying gun in accordance with claim 1, wherein the gun body has a tapered outer diameter gradually reduced from the outer threading, the stop flange and the outer thread to the second end of the gun body.

9. The spraying gun in accordance with claim 1, wherein the outer threading of the gun body has an end provided with a protruding stop wall which has a locking boss;

the first end of the outer casing has an end portion abutting the stop wall of the gun body and provided with a plurality of tooth-shaped locking grooves engaged with the locking boss of the stop wall of the gun body.

10. The spraying gun in accordance with claim 1, wherein when the stop rim of the control pipe is movable to abut the stop flange of the gun body, the first sealing portion of the control pipe presses the first seal ring, and the second sealing portion of the control pipe presses the second seal ring.

11. The spraying gun in accordance with claim 1, wherein the stop edge of the outer casing has a periphery provided with a plurality of slits so that the stop edge of the outer casing has a flexible feature.

12. The spraying gun in accordance with claim 1, wherein the stop rim of the control pipe is substantially cone-shaped.

13. The spraying gun in accordance with claim 1, wherein the first nozzle of the spraying head has a stepped shape;

the second nozzle of the control pipe has a substantially horn-shaped cross-sectional profile.

14. The spraying gun in accordance with claim 1, wherein the control pipe has a tapered inner diameter gradually reduced from the inner thread and the first sealing portion to the second sealing portion of the control pipe.

15. The spraying gun in accordance with claim 1, wherein the first seal ring is located between the outlet hole and the inlet hole of the gun body;

the second seal ring is located between the inlet hole of the gun body and the second nozzle of the control pipe.

16. The spraying gun in accordance with claim 1, further comprising a third seal ring mounted on an outer wall of the gun body to press an inner wall of the control pipe, wherein the outlet hole of the gun body is located between the first seal ring and the third seal ring.

17. A spraying gun, comprising:

a gun body having a first end having an inside provided with an inlet channel and a periphery provided with an outlet hole connected to the inlet channel and a second end having an inside provided with an outlet channel and a periphery provided with an inlet hole connected to the outlet channel;

a first seal ring mounted on the gun body;

a second seal ring mounted on the gun body;

a spraying head mounted on the second end of the gun body and having a first nozzle connected to the outlet channel of the gun body;

a control pipe rotatable and movably mounted on the gun body and having a first end provided with a second nozzle surrounding the spraying head, a second end provided with a first sealing portion detachably pressing the first seal ring to open or close a connection between the outlet hole and the inlet hole of the gun body and a mediate portion provided with a second sealing portion detachably pressing the second seal ring to open or close a connection between the inlet hole of the gun body and the second nozzle of the control pipe;

an outer casing mounted on the gun body to limit a movement of the control pipe;

wherein the outer casing has an outer wall provided with a plurality of anti-skid portions;

the control pipe has an outer wall provided with a plurality of anti-skid portions.

18. The spraying gun in accordance with claim 1, wherein the first end of the gun body has an outer wall provided with an O-ring.

* * * * *